United States Patent [19]

Gryskiewicz et al.

[11] 4,374,169

[45] Feb. 15, 1983

[54] ABRASION RESISTANT, REINFORCED SCREEN PANEL MEMBER

[75] Inventors: Gregory A. Gryskiewicz, North St. Paul; Raymond A. Koehler, Anoka, both of Minn.

[73] Assignee: UOP Inc., Des Plains, Ill.

[21] Appl. No.: 301,546

[22] Filed: Sep. 14, 1981

[51] Int. Cl.[3] ..... B32B 7/00

[52] U.S. Cl. ..... 428/221; 209/392; 209/400; 428/105; 428/256; 428/295; 428/364; 428/375; 428/378; 428/379; 428/397; 428/423.3

[58] Field of Search ..... 428/105, 256, 295, 373, 428/376, 378, 379, 397, 423.3, 423.9, 425.8, 221, 375, 364; 209/392, 400

[56] References Cited

U.S. PATENT DOCUMENTS

| | | | |
|---|---|---|---|
| 3,428,184 | 2/1969 | Kuper | 210/489 |
| 3,483,976 | 12/1969 | Williams | 209/395 |
| 3,557,276 | 1/1971 | Williams | 264/316 |
| 3,900,628 | 8/1975 | Stewart | 428/134 |
| 3,980,555 | 9/1976 | Freissle | 209/408 |
| 4,062,769 | 12/1977 | Simonson | 209/399 |
| 4,100,248 | 7/1978 | Adams | 264/273 |
| 4,120,785 | 10/1978 | Kanamori et al. | 209/401 |
| 4,247,007 | 1/1981 | Kai | 209/392 |
| 4,295,918 | 10/1981 | Benson et al. | 156/296 |

*Primary Examiner*—James J. Bell

*Attorney, Agent, or Firm*—James R. Hoatson, Jr.; Barry L. Clark; William H. Page, II

[57] ABSTRACT

Screen member for use in fixed or rotating screen support devices and in either a vibrating or non-vibrating mode for grading or dewatering comprises a first plurality of elongated, parallel surface wire members which are formed by extruding a resilient, abrasion resistant layer of elastomeric material completely around a core portion which is more rigid than the elastomeric layer. A second plurality of elongated, parallel support rod members arranged transverse to the first plurality are also formed by extruding a layer of elastomeric material completely around a more rigid core portion. The first and second plurality of wire members are bonded to each other at every intersection by a partial melting together of the contacting elastomeric layers under pressure. The melting is preferably insufficient to permit the core portions of the respective first and second wire members to bond to each other and produces a resilient joint at each intersection which enhances the ability of the screen to remain relatively free of lodged particles. The core portions of each of the first and second sets of wire members have a flexural modulus of at least 100,000 p.s.i. Blinding of the screen is minimized by having the open space between adjacent support rods at least 10 times greater than the slot width between adjacent surface wires.

13 Claims, 3 Drawing Figures

FIG. 1
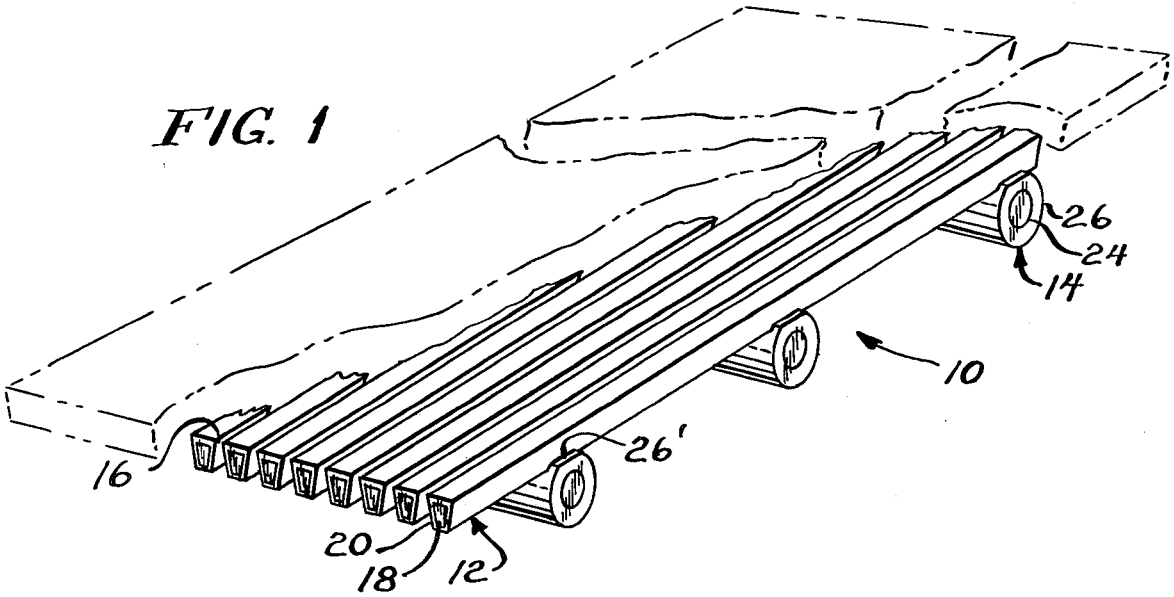
FIG. 2
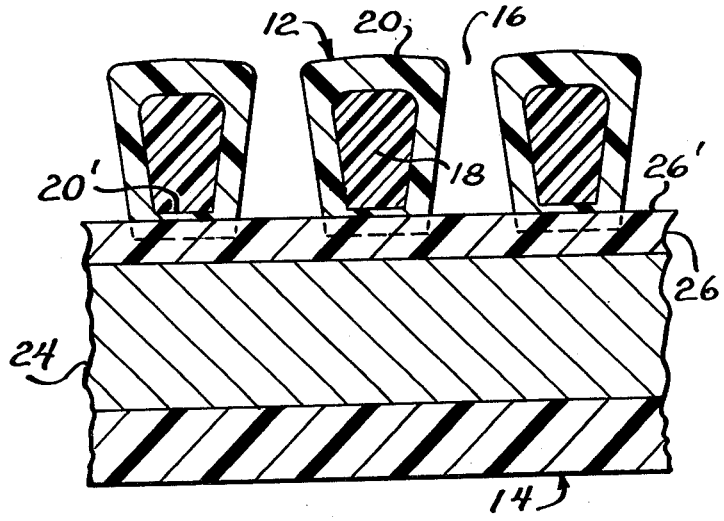
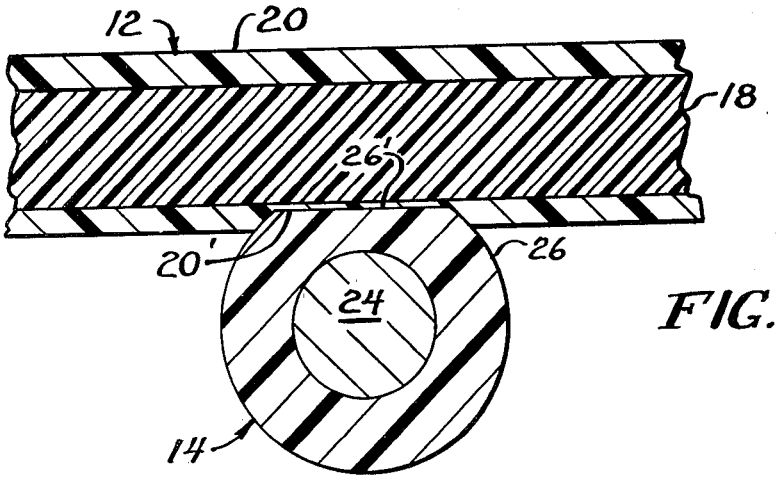
FIG. 3

ABRASION RESISTANT, REINFORCED SCREEN PANEL MEMBER

BACKGROUND OF THE INVENTION

The invention relates to elastomeric screen panels and particularly to polyurethane screen panels. It is known that polyurethane offers excellent abrasion resistance and a number of polyurethane screen panels are commercially available for use in severely abrasive mining applications for grading or dewatering. U.S. Pat. Nos. relating to such screens wherein elastomeric material is molded include 3,428,184, 3,483,976, 3,557,276, 3,900,628, 3,980,555, 4,062,769 and 4,100,248. U.S. Pat. No. 4,120,785 discloses a screen formed from melt bonded transverse layers of elongated polyurethane rope members which have a tensile core. The tensile core portions of the rope members in one layer have a high elongation at break and are preferably formed of twisted strands of fiber or metal, while the tensile core portions of the rope members which define the adjacent layer have a low elongation at break. Apparently, the rope members in each layer are substantially equally spaced. Also, being of filamentary construction, they would seem to have a very low flexural modulus. U.S. Pat. No. 4,247,007 shows a tensioned strand screen.

SUMMARY OF THE INVENTION

It is among the objects of the present invention to provide an abrasion resistant, reinforced screen panel member which will provide long life when contacted by abrasive material in either a vibrating or non-vibrating mode of operation. It is another object to provide such a screen panel which is sufficiently rigid that the support rods can be spaced from each other by at least about 10 times the spacing of the surface profile wires, thereby increasing the screen's open area and greatly reducing the tendency of the screen to become blinded.

In a preferred construction, the support rods comprise a rigid steel core portion about which a thick annular layer of polyurethane is extruded. Since the core is covered, low carbon steel is satisfactory. The surface wires preferably have an extruded polyurethane surface layer and a co-extruded core which may be formed of a more rigid polyurethane, or of polyvinyl chloride or ABS, for example. The shape of the surface and of the core is preferably trapezoidal to reduce blinding and to facilitate cooling of the extruded material. Where it is desirable to space the support rods quite far apart, such as 3 inches, it is usually preferable to extrude the polyurethane surface layer of the wires about a steel wire core. Such a core, which should also be of a trapezoidal shape, has a much higher flexural modulus than a plastic core, thus providing a sufficient rigidity to the wires over their relatively long unsupported portions so as to maintain a uniform slot width. A deep trapezoidal shape also provides significant beam strength. The cores of the wires and rods are much stiffer than the outer layer of polyurethane and have a flexural modulus of at least 100,000 p.s.i. The outer layer of polyurethane or other elastomer on the wires and rods preferably has a durometer surfficient to provide good abrasion resistance and a value of about 80 Shore A has proved satisfactory. Where the core of the wires is also polyurethane or other plastic, it is preferably one which has a durometer sufficient to provide substantial rigidity to the wires. A value of about 70 Shore D has been found to be satisfactory.

The welding process can be hot platen welding, vibration welding, electromagnetic welding, solvent welding, hot gas welding, or any other appropriate process used to join thermoplastic materials. Welds can be made individually or the entire panel can be assembled in a fixture and welded at one time. A machine suitable for assembling and welding polyurethane covered wires and rods into a panel is disclosed in a copending application U.S. Ser. No. 107,488, filed Dec. 26, 1979 now U.S. Pat. No. 4,295,918 and assigned to a common assignee.

BRIEF DESCRIPTION OF THE DRAWINGS

FIG. 1 is an isometric view, partially broken away, showing the improved screen panel;

FIG. 2 is a sectional view taken on line 2—2 of FIG. 1; and

FIG. 3 is a sectional view taken on line 3—3 of FIG. 1.

DETAILED DESCRIPTION OF THE PREFERRED EMBODIMENT

FIG. 1 illustrates a screen panel assembly 10 consisting of a first set of closely spaced parallel, surface profile wires 12 and a second set of widely spaced, parallel, support rods 14. Typically, the pitch or spacing distance between the centers of adjacent support rods 14 is about 1.5 inches. Thus, for an outside rod diameter of 0.25", the open space between adjacent rods is typically about 1.25 inches. The screen wires 12 have a maximum width at their upper surface of about 0.120", and are spaced apart sufficiently to provide slot openings 16 of a dimension appropriate to the size of the material being screened. Typically, the dimension 16 is about 0.040–0.080". Thus, for the dimensions noted, the open space between adjacent rods along the length of the slot 16 is from about 15–30 times the slot width. The magnitude of this relationship means that very little of the open area of the slots will be lost should portions of the slots 16 become clogged or "blinded" due to the presence of the underlying support rods 14. The possibility of "blinding" and its consequent reduction in the open area of the screen during use is lessened even further when the pitch between the support rods is increased further, such as to 3.0 inches. To achieve such a wide pitch between support rods, however, the screen wires 12 must be quite stiff. In such a situation, it is sometimes necessary to use a core member 18 comprising a solid steel wire inside the wire 12 in order to achieve a sufficiently high flexural modulus. A steel core member 18 would have the outer layer of abrasion resistant elastomeric material 20, preferably polyurethane, extruded around it. For more typical installations, where the rods 14 can be at a closer pitch, such as 1.5 inches, the core members 18 inside the wires 12 can have a flexural modulus as low as about 100,000 psi. Suitable core materials for the wires 12 include rigid polyvinyl chloride, ABS, and polyurethane, with the latter being preferable since it will bond to the outer layer of polyurethane if melted, while polyvinyl chloride will not. Either material is, however, preferred over steel for the core since two plastic materials can be co-extruded, a much simpler process than trying to extrude a uniform plastic coating around a trapezoidal shaped metal core. The typically larger and stronger rods 14 are almost always provided with a core 24 of solid steel wire to provide stiffness and rigidity to the overall panel 10. The rods 14 do not need a precisely dimensioned surface or a trapezoidal shape and can be made quite easily by extruding a polyurethane outer layer 26 around the round steel wire core 24.

FIGS. 2 and 3 are drawn to about 8 times normal size for clarity, while FIG. 1 is drawn to full size. As can be seen in these figures, the cores 18 in the wires 12 preferably remain separated from the cores 24 in the rods 14 when the polyurethane coatings 20 of the wires are melted into the polyurethane coatings 26 of the rods 14 to form the screen panel 10. The preferred amount of overlap of the wires 12 and rods 14 after they are melted together is 0.040" and should not exceed about 0.060". In the preferred embodiment, the wires 12 are trapezoidal in shape with an 8° side taper. They are about 0.140" high and 0.120" wide with the polyurethane coating 20 having a thickness on the upper wear surface of about 0.030" and a thickness on the three other sides of about 0.020". The rods 14 have an outer diameter of about 0.250" while the diameter of the steel core 24 is about 0.128".

In a preferred assembly method, a heater bar (not shown) is brought into pressure contact with the entire length of a selected support bar 14 to be attached and to those areas of all of the wires 12 which are to be bonded to the selected support bar when the heater bar is removed. The heater bar softens the polyurethane coatings 26 and 20 about 0.030" and 0.018" respectively, and causes the top of the circular rod member 14 to be flattened as shown at 14'. The heater bar also deforms the bottom of the wire members 12. Thus, when the heater bar is removed and the heated and flattened portions of the wires and the rods are forced together, the softened coatings 26, 20 will fuse together. A slight amount of additional compression will also take place and will enhance the bond. For the dimensions shown, it is apparent in FIG. 2 that a slight additional amount of penetration of the top surface 14' of the rod into the bottom coating 20 of the wire will eliminate the small thickness of coating material 20' and will bring the polyurethane surface 26' into contact with the material of the wire core 18. This presents no problem when the core 18 is also a polyurethane, since the two like materials will readily fuse to each other. However, when the core 18 is rigid polyvinyl chloride, for example, no fusion can take place and thus there will be no bond on the common surface between the coating 26' and the core 18. However, when the small gap 20' is present, the coating 20 will retain its mechanical bond with the core 18 and will also be completely fused to the coating 26.

The provision of rigid cores within the wires and rods provides many advantages besides those previously discussed. For example, the core 18 could be made of a color different than that of the outer layer 20. Thus, when the upper thickness of the layer 20 wears away sufficiently to expose the contrastingly colored core material, one would have a visible indication that it was time to replace the screen. For example, if a white core 18 of PVC were located inside a black polyurethane outer layer 20, it could be extruded into an exact location corresponding to the point below the wire's top surface at which the screen slots 16 would have widened to an unacceptable degree. Also, by altering the core material, or by changing its physical dimensions, the physical properties of the wire can be greatly modified while retaining the abrasion resistance benefits afforded by the outer skin. One possibility would be the varying of the stiffness or natural frequency of the screen panel, thus permitting a screen to be matched to the input force of a vibrating screen machine to produce a maximum excitation.

In addition, some studies have indicated that the ratio of surface energy to hardness is important in predicting a material's behavior to friction and wear. Conceivably, a two-material construction could effectively offer a very low surface energy to hardness ratio by using a material with a low surface energy over a reasonably hard core, thus proving the co-extruded or coated wire to have better resistance to abrasion than a solid polyurethane wire shape.

It will be readily obvious that the disclosed screen incorporating co-extruded or coated wires combines the many advantages of stainless steel screens such as maximum open area, V-shaped slot, continuous slot the length of the panel, high strength, rigidity, with the advantages of existing polyurethane screens; superior abrasion resistance for long life, corrosion resistance, and light weight.

We claim as our invention:

1. A reinforced, abrasion resistant screen member for use in either a vibrating or non-vibrating type screen apparatus comprising a first plurality of closely spaced elongated profiled surface wires arranged parallel to each other and in a plane so as to define elongated slots between the wires which have a width less than the width of the wires, each of said first plurality of wires including a rigid core portion having a flexural modulus of elasticity of at least 100,000 p.s.i. and a layer of a less rigid thermoplastic, abrasion resistant material extruded over it and in intimate bonded relationship to it; a second plurality of less closely spaced elongated support rods positioned in a plane and arranged parallel to each other and transverse to said first plurality of wires, each of said second plurality of support rods including a rigid core portion having a flexural modulus of elasticity of at least 100,000 p.s.i. and a layer of a less rigid thermoplastic, abrasion resistant material extruded over it and in intimate bonded relationship to it, said first plurality of wires and said second plurality of rods having portions of their layers of thermoplastic abrasion resistant material fused together in overlapping relationship at every intersection, the cores of said wires and rods being unfused and spaced from each other at every intersection, and the dimension of the open spaces between adjacent screen rods being at least 10 times the width dimension of the slots defined by the surface wires.

2. The screen member of claim 1 wherein the dimension of the open space between adjacent screen rods is at least 15 times the width dimension of the slots defined by the surface wires.

3. The screen member of claim 1 wherein said abrasion resistant material on said surface wires and on said support rods is polyurethane.

4. The screen member of claim 1 wherein said abrasion resistant material has a durometer of about 80 Shore A.

5. The screen member of claim 1 wherein said core portion of each of said surface wires has a cross-section which is of greater dimension in a vertical direction than in a horizontal direction when the wire is in a horizontal plane.

6. The screen member of claim 5 wherein said core portion of each of said surface wires has a cross-section which is trapezoidal and the outer cross-section of the wire is also trapezoidal, the vertical sides of said cross-sections being upwardly divergent.

7. The screen member of claim 3 wherein said support rods each have a core portion comprising a solid steel wire.

8. The screen member of claim 7 wherein said surface wires each have a core portion comprising a solid thermoplastic member.

9. The screen member of claim 8 wherein said thermoplastic member is polyvinyl chloride.

10. The screen member of claim 8 wherein said thermoplastic member is polyurethane.

11. The screen member of claim 7 wherein said surface wires each have a core portion comprising a generally trapezoidal-shaped solid steel wire, the open space between adjacent screen rods being at least 30 times the width dimension of the slots defined by the surface wires.

12. The screen member of claim 1 wherein the core portions of the surface wires are of a different color than the color of the extruded abrasion resistant material which overlies them whereby a wearing away of the abrasion resistant material during use will expose the core material and visually signal the need to replace the screen.

13. The screen member of claim 1 wherein said profiled surface wires have a height greater than their width and a cross-sectional shape that is trapezoidal with a generally flat top surface which is wider than its bottom surface and angled side surfaces which define tapered slots between the wires.

* * * * *